US011128058B2

(12) United States Patent
Dotlic et al.

(10) Patent No.: US 11,128,058 B2
(45) Date of Patent: Sep. 21, 2021

(54) WIDEBAND ANTENNA ARRAY

(71) Applicant: Decawave, Ltd., Dublin (IE)

(72) Inventors: Igor Dotlic, Dublin (IE); Giuseppe Ruvio, Dublin (IE); Jeff Clancy, Dublin (IE)

(73) Assignee: Decawave, Ltd., Dublin (IE)

( * ) Notice: Subject to any disclaimer, the term of this patent is extended or adjusted under 35 U.S.C. 154(b) by 77 days.

(21) Appl. No.: 16/741,398

(22) PCT Filed: Jun. 22, 2018

(86) PCT No.: PCT/EP2018/066734
§ 371 (c)(1),
(2) Date: Jan. 13, 2020

(87) PCT Pub. No.: WO2018/234533
PCT Pub. Date: Dec. 27, 2018

(65) Prior Publication Data

US 2020/0358204 A1 Nov. 12, 2020

(30) Foreign Application Priority Data

Jun. 23, 2017 (GB) ..... 1710073

(51) Int. Cl.
*H01Q 21/06* (2006.01)
*H01Q 9/04* (2006.01)
(Continued)

(52) U.S. Cl.
CPC ..... *H01Q 21/064* (2013.01); *H01Q 1/523* (2013.01); *H01Q 9/0407* (2013.01);
(Continued)

(58) Field of Classification Search
CPC .... H01Q 21/06; H01Q 21/061; H01Q 21/064; H01Q 21/065; H01Q 21/24; H01Q 1/52;
(Continued)

(56) References Cited

U.S. PATENT DOCUMENTS 4,208,660 A 6/1980 McOwen, Jr.
4,843,400 A * 6/1989 Tsao ..... H01Q 9/0428 343/700 MS
(Continued)

FOREIGN PATENT DOCUMENTS

CN 102769175 A 11/2012
CN 103151602 A 6/2013
(Continued)

OTHER PUBLICATIONS

Intention to Grant for European Patent Application No. 18733263.0, dated Sep. 16, 2020, 5 pages.
(Continued)

*Primary Examiner* — Jason Crawford
(74) *Attorney, Agent, or Firm* — Withrow & Terranova, PLLC

(57) ABSTRACT

An antenna array (10) for detecting an incoming radio wave (52) having an operating wavelength, comprising: a plurality of antenna elements (12) arranged in an array with a periodic repetition of the antenna elements (12). Each antenna element (12) comprises a slot (32) being shaped such that the polarisation of the corresponding antenna element (12) is non-linear, and having a first axis (A1) and a second axis (A2) orthogonal to the first axis. Each of the first and second axes (A1; A2) has a length in the range of about 0.05-0.2 times the operating wavelength of the incoming radio wave (52) and the ratio of the length of the first axis $A_1$ to the length of the second axis $A_2$ is between about 1-2.5. There is also a method of configuring an antenna array 10 for detecting an incoming radio wave (52), and a method of determining the angle of arrival of a radio wave (52) impinging on such an antenna array (10).

23 Claims, 4 Drawing Sheets

(51) Int. Cl.
*H01Q 13/10* (2006.01)
*H01Q 21/24* (2006.01)
*H01Q 1/52* (2006.01)

(52) U.S. Cl.
CPC ..... *H01Q 13/106* (2013.01); *H01Q 21/065* (2013.01); *H01Q 21/24* (2013.01)

(58) Field of Classification Search
CPC ..... H01Q 1/521; H01Q 1/523; H01Q 13/10; H01Q 13/106; H01Q 9/04; H01Q 9/0407
See application file for complete search history.

(56) References Cited

U.S. PATENT DOCUMENTS 4,929,959 A * 5/1990 Sorbello ..... H01Q 9/0428 343/700 MS
5,278,569 A * 1/1994 Ohta ..... H01Q 21/065 343/700 MS
5,418,541 A * 5/1995 Schroeder ..... H01Q 21/0075 343/700 MS
5,563,613 A * 10/1996 Schroeder ..... H01Q 21/0075 343/700 MS
6,198,437 B1 * 3/2001 Watson ..... H01Q 1/38 343/700 MS
6,252,549 B1 * 6/2001 Derneryd ..... H01Q 1/32 343/700 MS
6,456,241 B1 * 9/2002 Rothe ..... H01Q 21/0081 343/700 MS
7,471,254 B2 * 12/2008 Miura ..... H01Q 9/0414 343/700 MS
9,817,105 B2 * 11/2017 Ashida ..... H01P 3/16
10,020,594 B2 * 7/2018 Kim ..... H01Q 21/0006
2004/0070536 A1 4/2004 Stotler et al.
2008/0316131 A1 12/2008 Apostolos et al.
2011/0090129 A1 * 4/2011 Weily ..... H01Q 21/24 343/770
2012/0098703 A1 4/2012 Ferreol et al.
2015/0070217 A1 3/2015 Sharawi et al.
2016/0322714 A1 11/2016 Ying et al.

FOREIGN PATENT DOCUMENTS

CN 106793087 A 5/2017
CN 106887722 A 6/2017
DE 68925992 T2 7/1996
EP 0342175 A2 11/1989
JP S63098202 A 4/1988
JP 2004200869 A 7/2004

OTHER PUBLICATIONS

Extended European Search Report for European Patent Application No. 20175898.4, dated Aug. 28, 2020, 8 pages.
International Search Report and Written Opinion for International Patent Application No. PCT/EP2018/066734, dated Sep. 6, 2018, 10 pages.
International Preliminary Report on Patentability for International Patent Application No. PCT/EP2018/066734, dated Dec. 23, 2019, 9 pages.
Ranjan, P. et al., "Design of Circularly Polarized Rectangular Patch Antenna with single cut," Conference on Advances in Communication and Control Systems 2013 (CAC2S 2013), Apr. 2013, Atlantis Press, pp. 174-177.

* cited by examiner

WIDEBAND ANTENNA ARRAY

This application is a national phase entry of and related to PCT Application Serial No. PCT/EP2018/066734 ("PCT Application").

This application claims priority to the PCT Application, and hereby claims the benefit of the filing dates thereof pursuant to 37 CFT § 1.78(a)(4).

The subject matter of the PCT Application, in its entirety, is expressly incorporated herein by reference.

The present invention relates to wideband antenna arrays, particularly to ultra wideband antenna arrays designed and configured for reducing any error or ambiguity in the estimated Angle of Arrival (AoA) of an impinging radio wave, and/or for mitigating any influence on the phase relation from mutual coupling of an antenna with other antennas in the array.

BACKGROUND OF THE INVENTION

The present invention relates to communication systems, particularly to broadband or ultra wideband (UWB) communication systems. The number and variety of uses for such digital wireless communications systems are rapidly increasing, as are the requirements for such systems to be compact, low power and accurate. A useful parameter for providing positional information in such systems is the Angle of Arrival (AoA) of an impinging radio wave (as illustrated in FIG. 1) at the plane of the antenna array. The AoA can be estimated by measuring the Phase Difference of Arrival (PDoA) at the outputs of two or more receiving antennas that are elements of the antenna array. It is desirable to avoid or minimise any ambiguity of the AoA with respect to the measured PDoA for a ±90 degrees AoA interval (i.e. for the whole front half-hemisphere of the antenna array).

However, mutual coupling between antennas (elements) in an antenna array, particularly in arrays having patch elements, may affect the radiation pattern of the elements. Mutual coupling represents the influence of the geometry of nearby elements of the array on the current distribution of an element, and thus its radiation pattern. In particular, mutual coupling in arrays with patch elements, which will be considered here as example arrays, mainly comes from the existence of a common ground plane of the array. At electric distances below one half-wavelength of the impinging radio wave, mutual coupling between neighbouring elements can be rather strong. Due to the strong mutual coupling in the array, the effect of the coupling on the total radiation pattern of an element may be significant.

The problem with the radiation pattern that is due to mutual coupling in the AoA estimation arrays is that it is different for each array element. As such, it makes the PDoA a function of not only the AoA, but also of the polarisation of the impinging radio wave. Hence, the AoA cannot be correctly estimated without knowing the polarisation. This is further problematic because the polarisation of the impinging radio wave may be arbitrary due to arbitrary spatial orientation of the source of the impinging radio wave.

Therefore there is a desire to design antenna arrays for AoA estimation in such a way that the output PDoA depends on the polarisation of the impinging radio wave as little as possible. When AoA estimation is performed on the basis of broadband signals, accuracy in calculating the location of the signal's source can be largely improved. However, broadband signal processing requires challenging antenna design of the receiving array (i.e. phase linearity, group delay angular variation and fidelity factor of the array elements). The most common solution to this problem is to introduce dummy elements at both ends of a uniform linear array. The PDoA is measured between the active elements that are located in the middle of the array. The dummy elements serve to cancel out the parts of the radiation patterns of the active elements that come from the mutual coupling. However, the number of dummy elements needed may be rather large which makes the length of the array unacceptable for many applications.

Therefore it is believed that there remains a need for an improved antenna array design.

BRIEF SUMMARY OF THE INVENTION

In accordance with the present invention, from a first broad aspect, there is provided an antenna array for detecting an incoming radio wave having an operating wavelength, comprising:

- a plurality of antenna elements, the antenna elements arranged in an array with a periodic repetition of the antenna elements;
- wherein each antenna element comprises a slot, the slot being shaped such that the polarisation of the corresponding antenna element is non-linear and having a first axis and a second axis orthogonal to the first axis; and
- wherein each of the first and second axes of the slot has a length in the range of about 0.05-0.2 times the operating wavelength of the incoming radio wave and the ratio of the length of the first axis to the length of the second axis is between about 1-2.5.

Therefore embodiments of the present invention provide a wideband linear array which has a PDoA characteristic that depends very little on the polarisation of the impinging wave. Furthermore, the group delay of the elements of the array is optimized to vary very little with AoA, which allows usage of the array for precise radio distance estimation. The array is compact and low-profile to facilitate integration into a broad range of devices. Phase linearity and group delay angular variation of each element of the array is controlled across the operating bandwidth of the system. These characteristics prevent distortions of the broadband signal as it travels through the antennas to the processing unit.

The periodic repetition of the antenna elements may be at a minimum distance in the range of about 0.25-0.75 times an operating wavelength of an incoming radio wave or integer multiples of the selected fraction of the operating wavelength.

According to embodiments of the present invention, the inter-element spacing of the elements of the array is optimised to mitigate the influence of the mutual coupling between elements that may otherwise affect the PDoA and/or to avoid ambiguity of the estimated AoA with respect to the measured PDoA.

The shape of the slot may be one of: a polygon, optionally a diamond; and a circle. The shape of one or more of the plurality of antenna elements may be one of: a polygon; and a circle. One or more, or various combinations, of these shapes may make the antenna array particularly effective. The slot and/or antenna elements may take other suitable shapes.

The antenna array may be linear. The antenna array may be two dimensional. The plurality of antenna elements may be arranged in a grid, optionally wherein the grid is square, optionally wherein the grid is rectangular.

The antenna array may comprise exactly or at least two antenna elements, or exactly or at least three antenna elements, or exactly or at least four antenna elements, or exactly or at least five antenna elements, or exactly or at least six antenna elements.

The plurality of antenna elements may comprise two or more patch antenna elements.

The antenna arrays may be formed as or on printed circuit boards.

The slot may comprise a conducting member inserted therein, optionally wherein the conducting member is metallised. The conducting member may be substantially diamond-shaped, although it could take other suitable shapes.

The antenna array may receive electrical signals by one or more of: one or more co-axial cables; one or more vertical interconnect accesses (VIAs) and one or more co-planar waveguide (CPW) tracks; and one or more VIAs and one or more microstrips.

The antenna array may be a wideband array. The antenna array may be an ultrawide band (UWB) array. The antenna array may have a fractional bandwidth of at least about 10%. The antenna array may have a fractional bandwidth of about 10%.

The slot may be shaped such that the corresponding antenna element is dual polarised.

In accordance with the present invention, in a second broad aspect, there is provided an antenna system comprising two or more of the antenna arrays of the first broad aspect, and with any of the optional features mentioned.

A first of the two or more antenna arrays may lie in a first plane, and a second of the two or more antenna arrays may lie in a second plane, and wherein the first plane may be parallel to the second plane.

The two or more antenna arrays may be arranged back to back, optionally in opposite orientations.

A first antenna element of a first of the two or more antenna arrays may have a common axis with a second antenna element of a second of the two or more antenna arrays, optionally wherein the first and second antenna elements receive electrical signals along this axis.

In accordance with the present invention, in a third broad aspect, there is provided a method of configuring an antenna array for detecting an incoming radio wave having an operating wavelength, comprising:

arranging a first antenna element;

arranging a second antenna element, the second antenna element spaced apart from the first antenna element;

wherein each antenna element comprises a slot and the method further comprises:

shaping the slot such that the polarisation of the corresponding antenna element is non-linear and has a first axis and a second axis orthogonal to the first axis; and shaping the slot such that each of the first and second axes of the slot has a length in the range of about 0.05-0.2 times the operating wavelength of the incoming radio wave and the ratio of the length of the first axis to the length of the second axis is between about 1-2.5.

The second antenna element may be spaced apart from the first antenna element by a minimum distance in the range of about 0.25-0.75 times an operating wavelength of an incoming radio wave or integer multiples of the selected fraction of the operating wavelength.

In accordance with the present invention, in a fourth broad aspect, there is provided a method of determining the Angle of Arrival (AoA) of a radio wave impinging on the antenna array of the first broad aspect, and with any of the optional features mentioned, optionally wherein the antenna array is in the antenna system of the second broad aspect, and with any of the optional features mentioned, comprising:

detecting a radio wave impinging on the antenna array;

measuring the Phase Difference of Arrival (PDoA) at outputs of two or more of the antenna elements; and determining the AoA of the impinging radio wave based on the measured PDoA.

BRIEF DESCRIPTION OF THE DRAWINGS

Embodiments of the present invention will now be described, by way of example only, and with reference to the accompanying drawings, in which.

Figure 1:
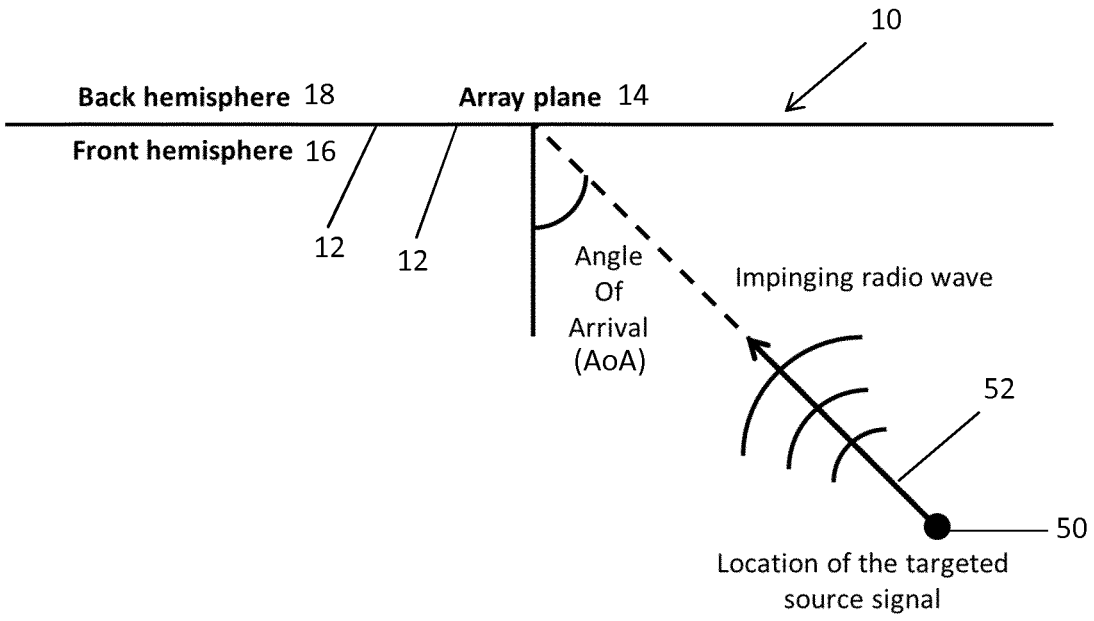
FIG. 1 illustrates a radio wave from a source impinging on an array of antenna elements, which array can be an antenna array in accordance with embodiments of the present invention.

In the drawings, similar elements will be similarly numbered whenever possible. However, this practice is simply for convenience of reference and to avoid unnecessary proliferation of numbers, and is not intended to imply or suggest that the invention requires identity in either function or structure in the embodiments.

DETAILED DESCRIPTION OF THE INVENTION

As shown in FIG. 1, an antenna array 10, which comprises a plurality of antennas or elements 12, has an array plane 14 that defines a front hemisphere 16 and a back hemisphere 18 of the array 10. Radio waves 52 from a source 50 impinge on the elements 12 of the array 10 at an Angle of Arrival (AoA). Determining the AoA provides a measure of the direction of propagation of the radio wave impinging on the elements 12 of the array 10. The AoA is determined by measuring the Phase Difference of Arrival (PDoA) at two or more of the elements 12 of the array 10.

Figure 2:
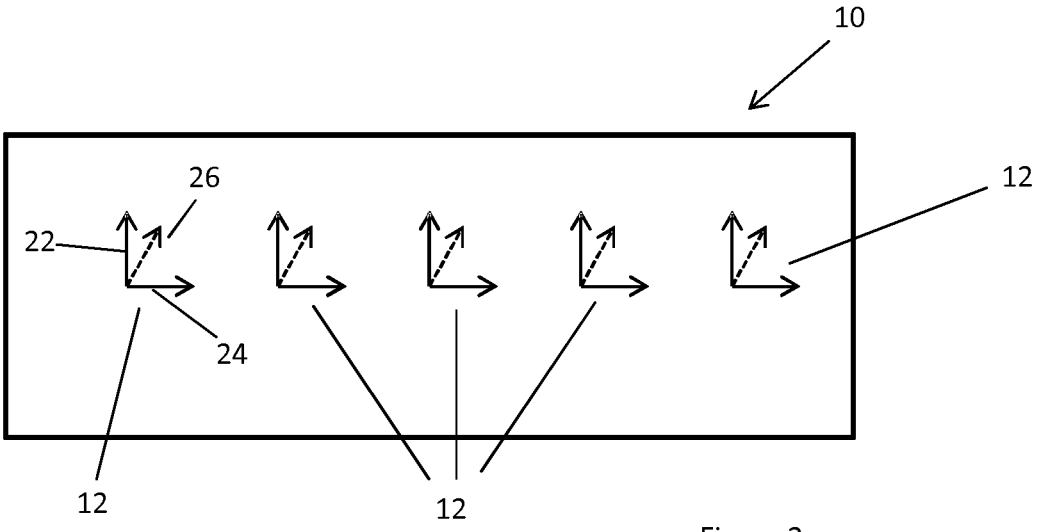
FIG. 2 illustrates a linear antenna array comprising five antenna elements in accordance with embodiments of the present invention.

FIG. 2 illustrates a linear antenna array 10 comprising five antenna elements 12, which are broadband antennas. Of course, embodiments of the invention are not limited to having five antenna elements and fewer (two, three or four elements 12) or more (six elements 12 or more) may be provided in accordance with present invention. Additionally or alternatively, the array 10 is not limited to being a linear array and may have other configurations, such as a grid of elements 12 or other suitable arrangement. Each of the elements 12 in the linear array 10 is a dual-polarised element 12. The vertical 22 and horizontal 24 electric field components and the resulting electric field component 26 are illustrated for each element 12.

Figure 3:
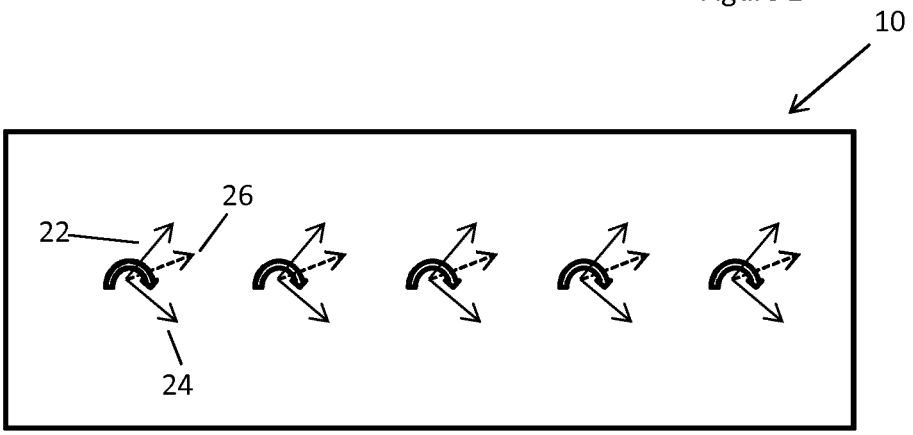
FIG. 3 illustrates the impact of ground plane truncation and mutual coupling on inter-element phase coherence in accordance with embodiments of the present invention.

As further illustrated in FIG. 3, the impact of ground plane truncation and mutual coupling on inter-element phase coherence is limited by the arrangement of the elements 12 of the linear array 10. As discussed above, each element 12 of the array 10 is dual-polarised. This enables the array 10 to be sensitive to the incident signal 52 with arbitrary polarisation. The electric field polarisations 22, 24, 26 are coherent in phase for any polarisation of the impinging wave 52, as shown in FIG. 3. The impact of the diffraction from the ground plane edges and of the mutual coupling between elements 12 of the array 10 on the phase relation between the array elements 12 is limited. This behaviour holds across the broad frequency band that the system is required to accurately estimate the AoA of the source 50 of the impinging signal 52.

The spacing between the elements 12 (the inter-element spacing) is optimised for at least two reasons. Firstly the optimised spacing mitigates the influence of the mutual coupling that may affect the PDoA. Additionally or alternatively the optimised spacing avoids ambiguity in the estimated AoA with respect to the measured PDoA. Phase linearity and group delay angular variation of each element 12 of the array 10 is controlled across the operating bandwidth of the system. These characteristics prevent distortions of the broadband signal 52 as it travels through the antennas 12 to the processing unit.

Figure 4:
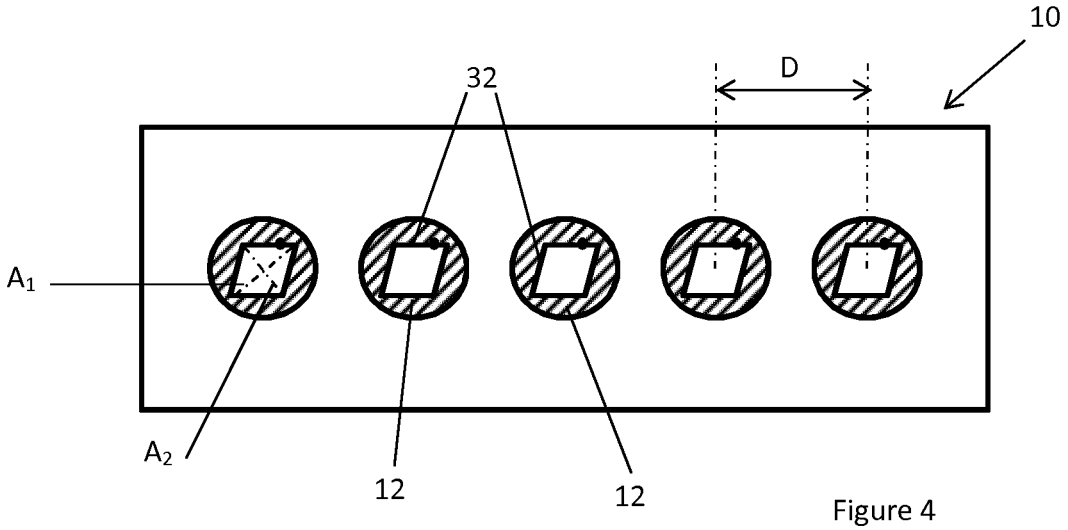
FIG. 4 illustrates a five element array of diamond-slotted broadband patch antennas in accordance with embodiments of the present invention.
Figure 5:
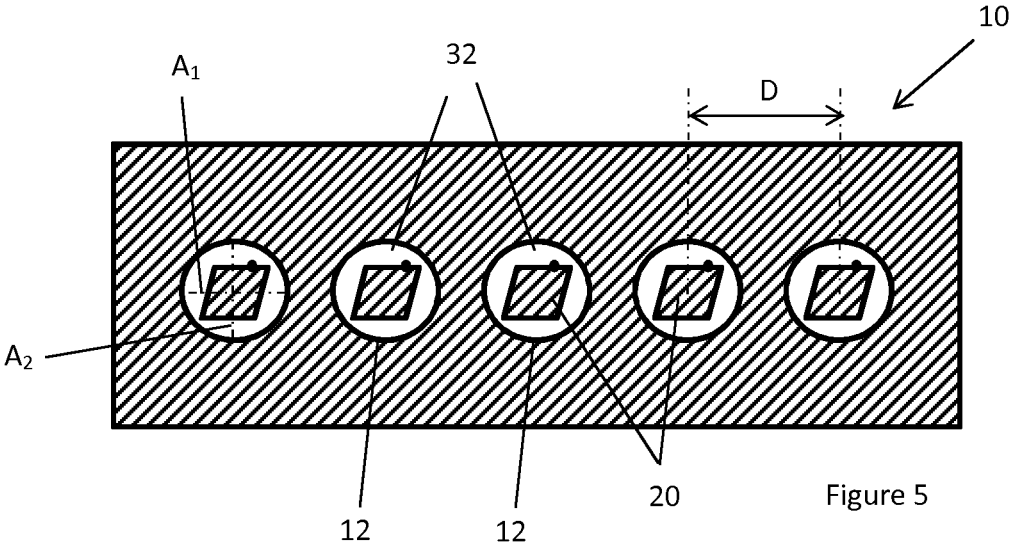
FIG. 5 illustrates a five element array of broadband circular slot antennas with diamond-shaped metallic insertion in accordance with embodiments of the present invention.

As illustrated in FIG. 4, the elements 12 of the array 10 in this exemplary arrangement are printed patch antennas 12. Each element 12 has a slot 32 cut out from the radiating element 12. The patch antennas 12 consists of a ground plane and a radiating element 12 which may be suspended or printed on dielectric material. The radiating element 12 may have circular or polygonal shape; in this Figure the radiating element 12 is circular. The slot 32 may have rectangular or arbitrary geometry with two main or dominant axes, which are substantially orthogonal to each other (within operational tolerances). The slot 32 comprises two dominant axes ($A_1$, $A_2$), and whilst the slot shapes mentioned herein work well, some particularly well, the slots 32 of the present invention are not intended to be restricted to any specific shape. Other shapes not mentioned herein may not significantly affect the function of the array, and so the present invention is intended to cover such other shapes. Where a polygonal shape is employed, for instance a substantially diamond shape, one or more of the corners and/or edges of the polygon being chamfered and/or irregular and/or non-linear would still allow the slot to function as required, due to the two dominant axes and minor variations in shape should not significantly affect the performance. It is noted that, according to Babinet's Principle, a unit element of an array may be a printed slot antenna with a metallised member inserted in the radiating aperture. This is within the scope of embodiments of the present invention. As discussed above, the slot antenna 12 of the array 10 of FIG. 3 consists of a ground plane and a radiating aperture which may be suspended or printed on dielectric material. The radiating aperture may have circular or polygonal shape with two main orthogonal axes ($A_1$, $A_2$). The length of each axis ($A_1$, $A_2$) may vary between about 0.05 and about 0.2 times the wavelength corresponding to the centre frequency of the operating bandwidth of the radio wave 52. The ratio between the longer axis ($A_1$) and the shorter axis ($A_2$) may vary between about 2.5 and about 1. The array 10 is obtained by a periodic repetition of the unit element 12 with a distance (D) between about 0.25 and about 0.5 times the wavelength corresponding to the centre frequency of the operating bandwidth of the radio wave 52. The distance (D) may be larger than this, which may give multiple PDoA solutions that may be resolved using various methods. FIG. 4 is an example according to an embodiment of the present invention and illustrates a five-element 12 array of diamond-slotted 32 broadband patch antennas 12. The slots 32 may take other shapes. FIG. 5 is an example according to another embodiment of the present invention and illustrates a five-element 12 array of circular-slotted 32 broadband antennas 12, having diamond-shaped metallic members inserted therein. The array 10 is made with Printed Circuit Board (PCB) technology to enable inexpensive manufacturability and compactness.

The slots in the patches are optimised to have nearly constant group delay for AoAs in ±90 degrees range, i.e. in the whole front half-hemisphere of the array.

Due to the above-described mechanisms, an array 10 according to the invention has a PDoA on its output that varies little with the polarisation of the impinging wave 52 for AoAs in ±90 degrees range, i.e. in the whole front half-hemisphere 16 of the array 10. Due to the optimised geometry of the array elements 12, an array 10 according to the invention has nearly constant group delay for AoAs in ±90 degrees range, i.e. in the whole front half-hemisphere 16 of the array 10, which allows precise ranging, regardless of the AoA. For the patch antennas 12 with slots 32, the shape of the slots 32 in the patch antennas 12 is used to alter the otherwise strongly linear polarisation of the antennas 12. The slots 32 of the patches 12 are optimised to achieve a large operating band of the antennas 12 (about 10% fractional bandwidth). As previously discussed, the slots 32 of the patches 12 are optimised to make the antennas 12 sensitive for any polarisation of the impinging wave 52 for AoAs in ±90 degrees range, i.e. in the whole front half-hemisphere 16 of the array 10. Therefore the illustrated arrays 10 in accordance with the invention are advantageous compared with known arrays.

Figure 6:
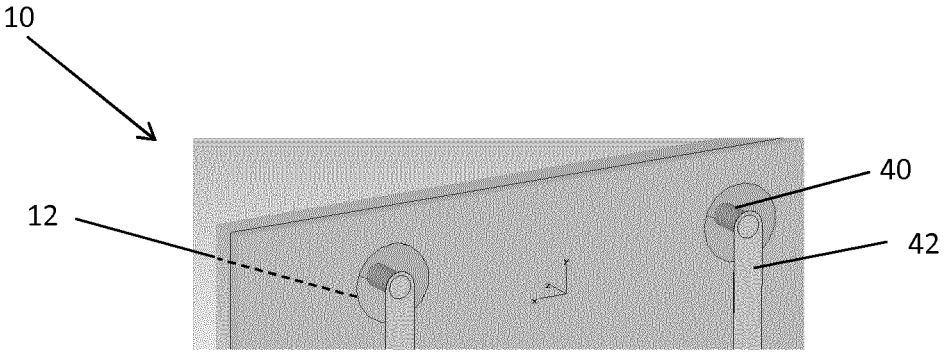
FIG. 6 illustrates microstrips on the back of an array to feed patch antennas through feeding vias in accordance with embodiments of the present invention, with transparent substrate for ease of reference.
Figure 7:
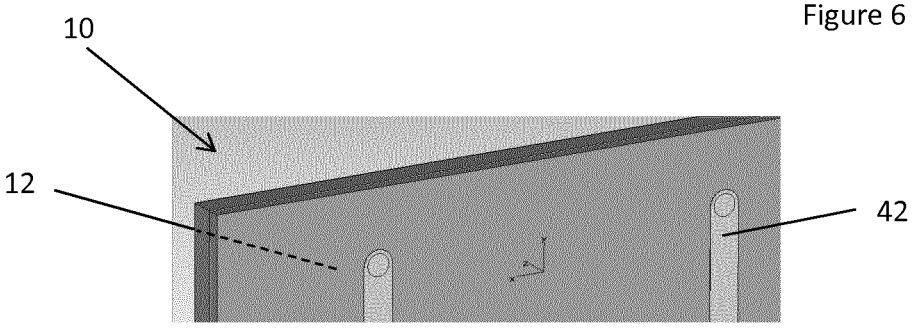
FIG. 7 illustrates the array of FIG. 6 with non-transparent substrate.

The antennas 12 of the arrays 10 discussed above may be fed by any suitable means, for example by coaxial cables, or with vias and co-planar waveguide (CPW) tracks, or, as illustrated in FIGS. 6 and 7, with vias 40 and microstrips 42. FIG. 6 has transparent substrate so that the vias 40 are visible, whereas FIG. 7 has non-transparent substrate so the vias 40 cannot be seen. The microstrips 42 at the back of the anchor point of each element 12 feeds the patches 12 through the feeding vias 40 as illustrated in FIG. 6.

Figure 8:
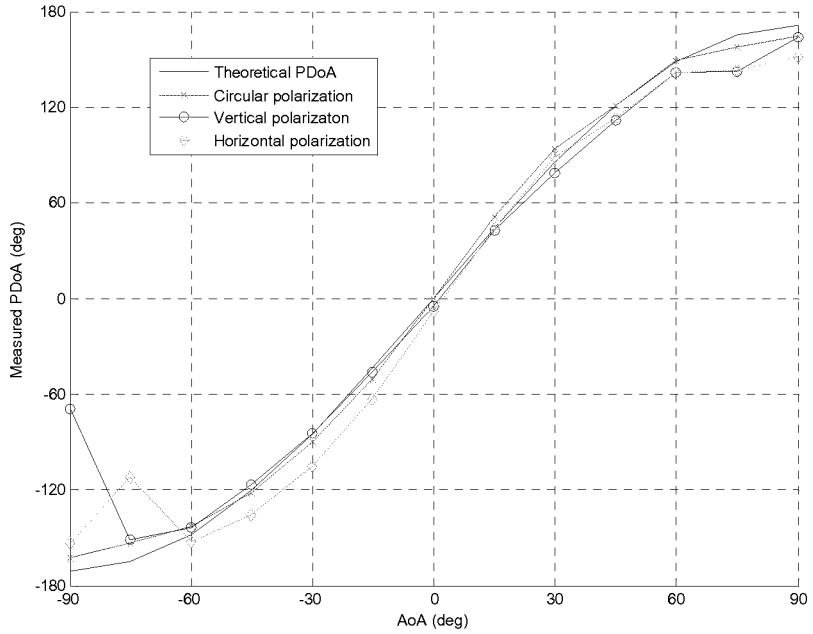
FIG. 8 is a graph illustrating the effectiveness of an embodiment of the present invention over the whole front half-hemisphere of an array.

FIG. 8 is a graph showing experimental results from an embodiment of the present invention, and illustrates the effectiveness of the embodiment over the whole front half-hemisphere 16 of the array 10. The Y-axis shows the measured PDoA and the X-axis shows the AoA from −90 to +90 degrees. As illustrated in FIG. 8, embodiments of the invention have a small dependence of the measured PDoA on the polarization of the impinging wave 52, whether the polarisation is vertical, horizontal, or circular, compared with the theoretical PDoA.

Figure 9:
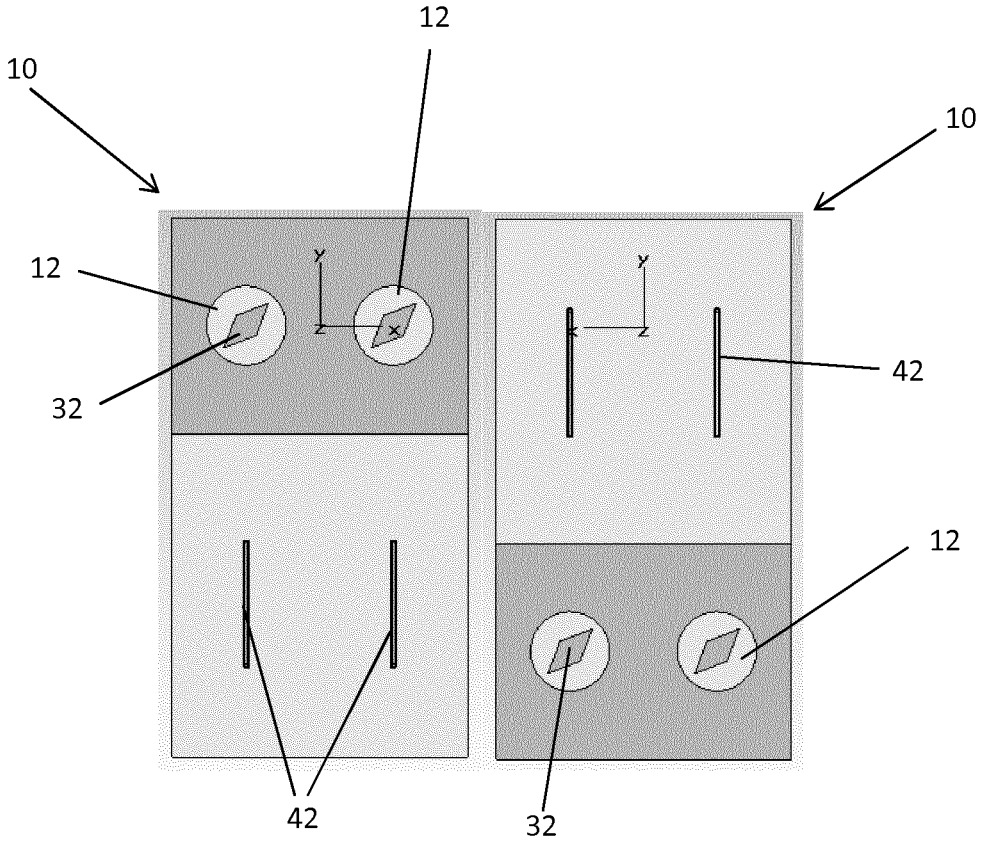
FIG. 9 illustrates a two-by-two array arrangement in accordance with embodiments of the present invention.

Different arrays 10 are discussed above and various embodiments are disclosed. It is also within the scope of the present invention to combine two or more arrays 10 according to the present invention. For example, multiple arrays may be positioned in different geometries in order to provide for better angular coverage. One example is illustrated in FIG. 9, in which a two-by-two array arrangement is shown (the top and bottom layer), each array 10 comprising two elements 12 that are diamond-slotted 32 patch antennas 12, and illustrating the microstrips 42 to feed the elements 12 of the opposite layer. Other configurations are of course possible.

Although the present invention is described above in the context of particular embodiments, one of ordinary skill in the art will readily realise that many modifications may be made in such embodiments to adapt to specific implementations. The scope of the invention is defined by the appended claims.

The invention claimed is:

1. An antenna array for detecting an incoming radio wave having an operating wavelength, comprising:

a plurality of antenna elements, the antenna elements arranged in an array with a periodic repetition of the antenna elements;

wherein each antenna element comprises a slot, the slot being shaped such that the polarization of the corresponding antenna element is non-linear and having a first axis and a second axis orthogonal to the first axis; and wherein each of the first and second axes of the slot has a length in the range of about 0.05-0.2 times the operating wavelength of the incoming radio wave and the ratio of the length of the first axis to the length of the second axis is between about 1-2.5.

2. The antenna array of claim 1, wherein the periodic repetition of the antenna elements is at a minimum distance in the range of about 0.25-0.75 times an operating wavelength of an incoming radio wave or integer multiples of the selected fraction of the operating wavelength.

3. The antenna array of claim 1, wherein the shape of the slot is one of:

a polygon, optionally a diamond; and a circle.

4. The antenna array of claim 1, wherein the shape of one or more of the plurality of antenna elements is one of:

a polygon; and a circle.

5. The antenna array of claim 1, wherein the antenna array is linear.

6. The antenna array of claim 1, wherein the antenna array is two dimensional.

7. The antenna array of claim 6, wherein the plurality of antenna elements are arranged in a grid, optionally wherein the grid is square, optionally wherein the grid is rectangular.

8. The antenna array of claim 1, comprising exactly or at least two antenna elements.

9. The antenna array of claim 1 comprising exactly or at least three antenna elements, optionally exactly or at least four antenna elements, optionally exactly or at least five antenna elements, optionally exactly or at least six antenna elements.

10. The antenna array of claim 1, wherein the plurality of antenna elements comprises two or more patch antenna elements.

11. The antenna array of claim 1, wherein the antenna arrays are formed as or on printed circuit boards.

12. The antenna array of claim 1, wherein the slot comprises a conducting member inserted therein, optionally wherein the conducting member is metallized.

13. The antenna array of claim 1, wherein the antenna array receives electrical signals by one or more of:

one or more co-axial cables;

one or more vertical interconnect accesses (VIAs) and one or more co-planar waveguide (CPW) tracks; and one or more VIAs and one or more microstrips.

14. The antenna array of claim 1, wherein the antenna array is an ultrawide band (UWB) array.

15. The antenna array of claim 1, the antenna array having a fractional bandwidth of at least about 10%.

16. The antenna array of claim 1, the slot being shaped such that the corresponding antenna element is dual polarized.

17. An antenna system comprising two or more of the antenna arrays of claim 1.

18. The antenna system of claim 17, wherein a first of the two or more antenna arrays lies in a first plane, and a second of the two or more antenna arrays lies in a second plane, and wherein the first plane is parallel to the second plane.

19. The antenna system of claim 17, wherein the two or more antenna arrays are arranged back to back, optionally in opposite orientations.

20. The antenna system of claim 17, wherein a first antenna element of a first of the two or more antenna arrays has a common axis with a second antenna element of a second of the two or more antenna arrays, optionally wherein the first and second antenna elements receive electrical signals along this axis.

21. A method of determining the Angle of Arrival (AoA) of a radio wave impinging on the antenna array of claim 1, optionally wherein the antenna array is in the antenna system of claim 17, comprising:

detecting a radio wave impinging on the antenna array;

measuring the Phase Difference of Arrival (PDoA) at outputs of two or more of the antenna elements; and determining the AoA of the impinging radio wave based on the measured PDoA.

22. A method of configuring an antenna array for detecting an incoming radio wave having an operating wavelength, comprising:

arranging a first antenna element;

arranging a second antenna element, the second antenna element spaced apart from the first antenna element;

wherein each antenna element comprises a slot and the method further comprises:

shaping the slot such that the polarization of the corresponding antenna element is non-linear and has a first axis and a second axis orthogonal to the first axis; and shaping the slot such that each of the first and second axes of the slot has a length in the range of about 0.05-0.2 times the operating wavelength of the incoming radio wave and the ratio of the length of the first axis to the length of the second axis is between about 1-2.5.

23. The method of claim 22, wherein the second antenna element is spaced apart from the first antenna element by a minimum distance in the range of about 0.25-0.75 times an operating wavelength of an incoming radio wave or integer multiples of the selected fraction of the operating wavelength.

* * * * *